US005280800A

United States Patent [19]

Pirrallo

[11] Patent Number: 5,280,800

[45] Date of Patent: Jan. 25, 1994

[54] REMOVABLE ONE PIECE WALKER SEAT

[76] Inventor: Frank G. Pirrallo, 9143 Brandy Ct., Spring Valley, Ohio 45370

[21] Appl. No.: 852,788

[22] Filed: Mar. 17, 1992

[51] Int. Cl.[5] ..... A61H 3/04

[52] U.S. Cl. ..... 135/67; 297/5; 135/65

[58] Field of Search ..... 135/67; 297/5, 6, 277, 297/278; 472/118; 5/120, 122, 127, 129, 130

[56] References Cited

U.S. PATENT DOCUMENTS

| | | | |
|---|---|---|---|
| 2,459,066 | 1/1949 | Duke . | |
| 2,798,533 | 7/1957 | Frank . | |
| 3,354,893 | 11/1967 | Schmerl . | |
| 3,778,052 | 12/1973 | Andow et al. | 272/70.4 |
| 3,993,349 | 11/1976 | Neufeld et al. | 297/6 |
| 4,415,198 | 11/1983 | Brearley | 297/6 |
| 4,532,948 | 8/1985 | Burrows | 135/67 |
| 4,621,804 | 11/1986 | Mueller | 272/70.3 |
| 4,708,274 | 11/1987 | Roche | 224/273 |
| 4,974,620 | 12/1990 | Quillan et al. | 135/67 |

*Primary Examiner*—Carl D. Friedman
*Assistant Examiner*—Matthew E. Leno
*Attorney, Agent, or Firm*—Barbara Joan Haushalter

[57] ABSTRACT

An integral, removable walker seat is easily attachable and detachable by persons having limited dexterity, and can be folded and transported when not in use. The walker seat comprises a substantially rectangular sheet of flexible material on which the user can sit. The sheet is attachable to opposite horizontal frame members of the walker via two pairs of bars affixed to the narrow ends of the sheet. The sheet and the bars cooperate to form a seat when the sheet is suspended across and engaged to the opposite horizontal frame members of the walker.

6 Claims, 4 Drawing Sheets

REMOVABLE ONE PIECE WALKER SEAT

BACKGROUND OF THE INVENTION

The present invention relates to invalid supporting frames and, more particularly, to a removable flexible material seat adapted for use on invalid supporting devices, such as walkers.

Various portable supporting frames are known which enable or assist handicapped, invalid, or infirm persons to walk. These frames, or walkers, assist a person who has difficulty in walking to keep his or her balance and they also enable part of the invalid's weight to be supported by his or her arms. The prior art is replete with a variety of such walkers, most of which have similar operation and construction, with minor differences in configuration and dimension.

It is also known to provide walkers with a seating arrangement so that if the user should become tired, he or she will have a seat readily available. It will be appreciated that many invalid persons become tired quite easily and it is important that such persons not overexert themselves.

One approach to a walker seat is described in U.S Pat. No. 4,621,804, issued to Mueller on Nov. 11, 1986. The Mueller patent discloses a walker having a frame extending around three sides, and a closure bar to selectively close the fourth side. A removable seat is attached between opposite sides of the frame so the user is surrounded on four sides by the frame. The user straddles the seat when he or she desires a rest. Unfortunately, the straddling position is difficult for an invalid to get into and out of. To make it easier for the invalid to enter and exit the walker, the seat is removable from at least one side. However, the attachments and height adjustments for the seat include fastenings which are relatively small, requiring dexterity to handle and make workable. The persons who use walkers, such as the elderly, infirm, handicapped, and disabled, tend to have particular difficulty with the dexterity required to handle the small fastenings disclosed in the Mueller patent, leaving the user unable to remove, attach, or adjust the seat without help.

Another walker seating arrangement is shown in U.S. Pat. 3,993,349, issued to Neufeld et al on Nov. 23, 1976. The Neufeld patent discloses a walker having a temporary seat constructed from a sling of canvas or other flexible material. The seat, which is quite narrow, has a loop formed at each end so that each end can be supported by a T-shaped bar. The upper end of each T-shaped bar is bent so that the bar can engage in a specially designed metal block. The construction taught by the patent requires specialized metal parts which increase the cost of the seat arrangement. In addition, carrying the seat upon the person when not in use would be cumbersome since the metal T-shaped members can not be folded. Finally, the seat taught by this patent distributes the weight of the invalid over a relatively small area of the body, which can cause discomfort and insecurity.

One patent which tries to overcome the problems associated with folding cumbersome seats is disclosed in U.S. Pat. No. 4,415,198, issued to Brearley on Nov. 15, 1983. The seat in the Brearley patent is a rectangular, foldable sheet of material, which can be detached and folded when not in use. The seat is mounted to the walker frame on four detachably connected hooks using ordinary hose clamps. This requires that the user have special tools and keep track of extra pieces when detaching or attaching the seat.

It is seen then that there exists a need for a removable walker seat which overcomes the problems associated with existing seats, by being easily attachable and detachable for persons having limited dexterity, is easily folded and transported when not in use, and consists of a one piece construction, eliminating special tools and extra pieces.

SUMMARY OF THE INVENTION

This need is met by the system according to the present invention, wherein a removable foldable walker seat comprises a one-piece construction with no loose pieces or tools.

In accordance with one aspect of the present invention, a seat for a walker comprises a substantially rectangular sheet of flexible material on which a walker user can sit. The sheet is attachable to and detachable from opposite horizontal frame members of the walker via a plurality of bar engaging and disengaging means affixed to narrow ends of the sheet. The sheet and the plurality of bar engaging and disengaging means cooperate to form a seat when the sheet is suspended across and engaged to the opposite horizontal frame members of the walker. The bar engaging and disengaging means interact at each of the two narrow ends of the sheet to securely lock the seat in place.

Accordingly, it is an object of the present invention to provide an integral walker seat having no loose tools or pieces required. It is a further object to provide such a walker seat which is removably attached to a walker. It is an advantage of the present invention that such a removably attachable seat is easily folded and transported when not in use. It is a further advantage that the seat of the present invention is adaptable for use on a wide variety of existing walkers, without requiring modifications.

Other objects and advantages of the invention will be apparent from the following description, the accompanying drawings and the appended claims.

DETAILED DESCRIPTION OF THE PREFERRED EMBODIMENTS

The present invention provides for a walker seat which can be temporarily attached to a standard invalid supporting walker device. The seat is a one-piece construction having no loose pieces or tools required for attaching or detaching the seat from the walker. The seat is securable in place such that it will not slip out of position. When the seat is detached from the walker, it can be folded and easily transported.

Figure 1:
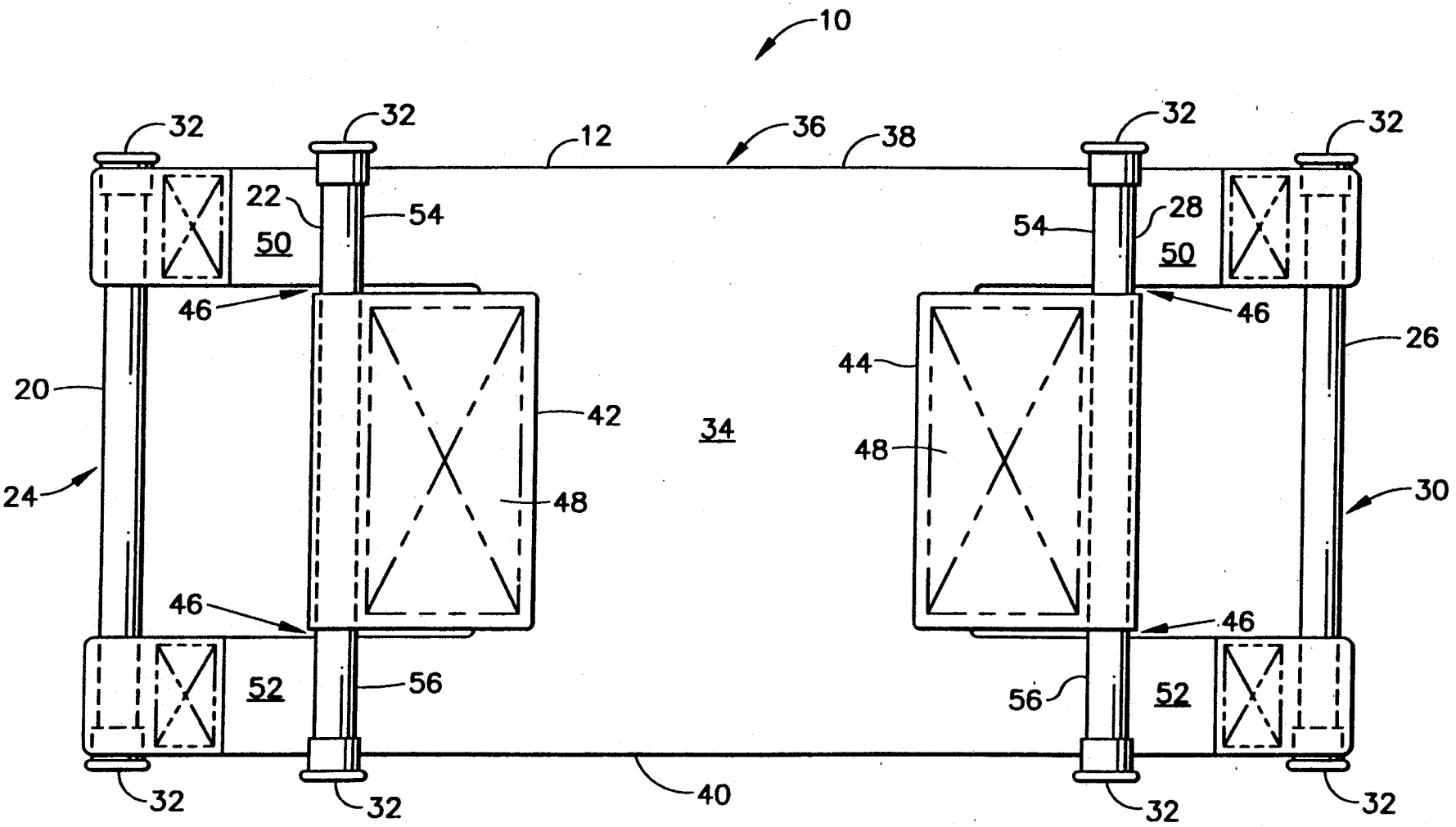
FIG. 1 is a top view of the walker seat of the present invention.
Figure 2A:
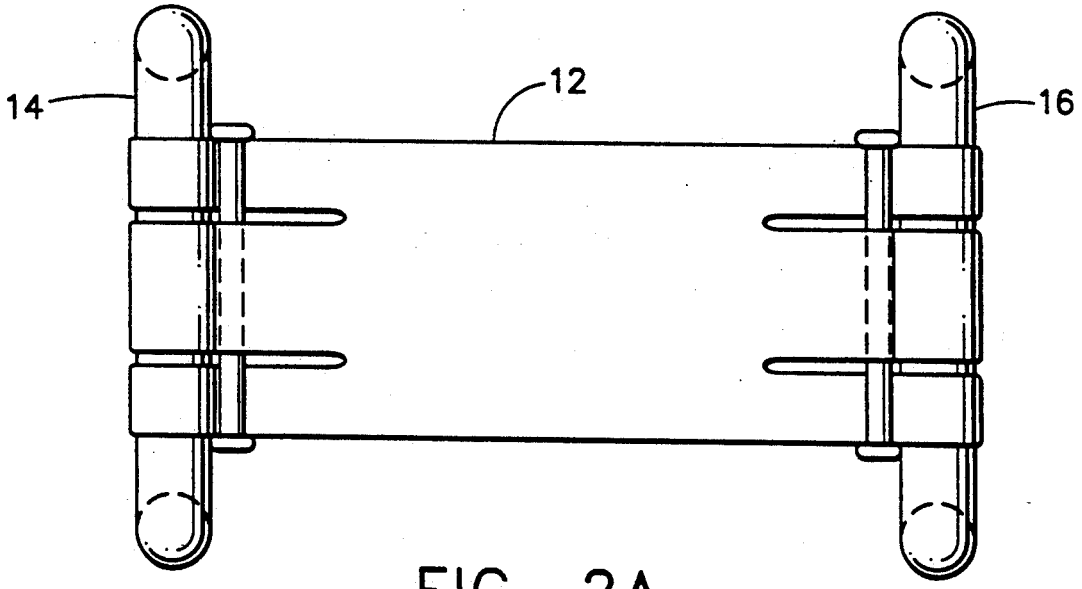
FIGS. 2A and 2B show a top view and a front view, respectively, of the seat of FIG. 1, attached to a walker.
Figure 2B:
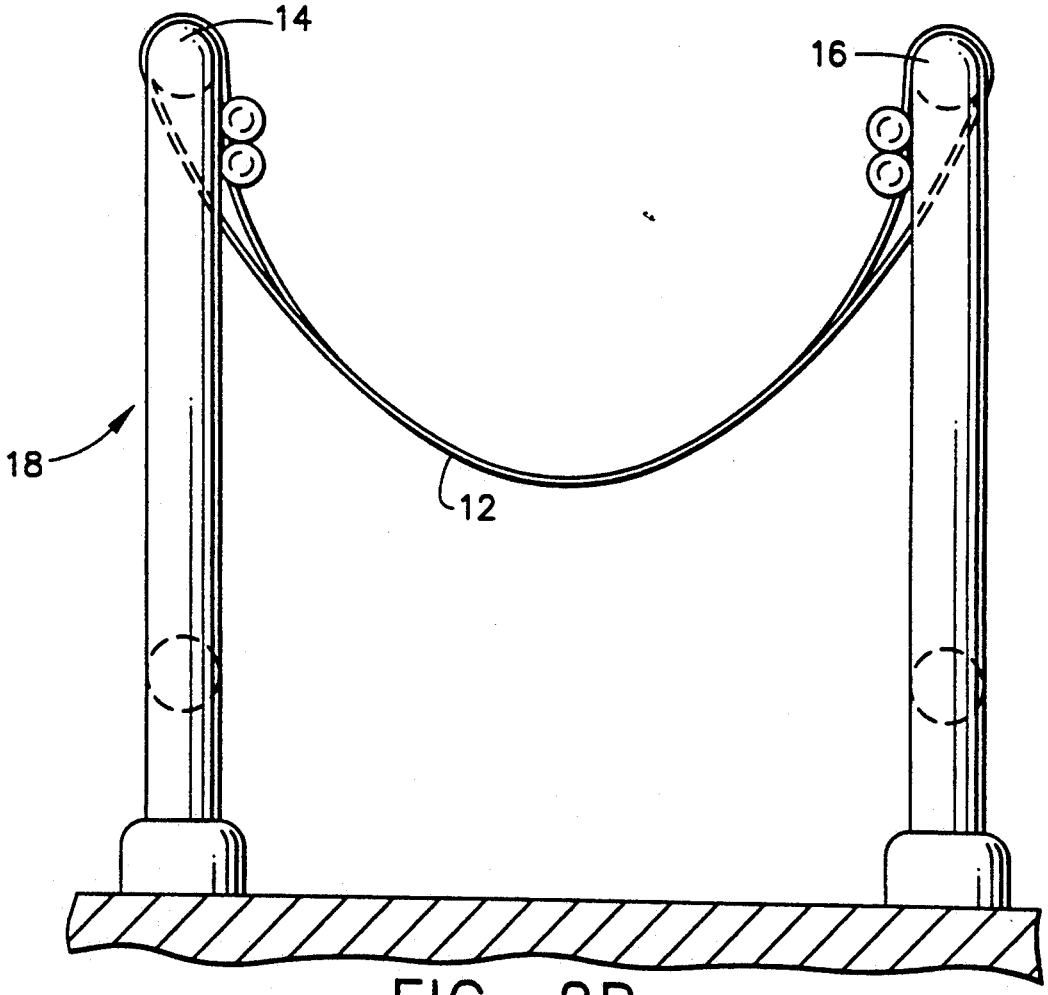

Referring now to the drawings, in FIG. 1 there is illustrated a top view of a walker seat 10 in an unfolded position. The walker 10 seat comprises a substantially rectangular sheet of flexible material 12 on which the user can sit. The sheet 12 is attachable to opposite horizontal frame members 14 and 16, as shown in FIGS. 2A and 2B, of a walker 18. Engaging and disengaging means 20 and 22 are affixed to a first narrow end 24 of the sheet 12 and engaging and disengaging means 26 and 28 are affixed to a second narrow end 30 of the sheet 12. The sheet 12 and the engaging and disengaging means 20, 22, 26, and 28 cooperate to form the seat 10 when the sheet is suspended across and engaged to the opposite horizontal frame members 14 and 16 of the walker 18.

In a preferred embodiment of the invention, the engaging and disengaging means 20, 22, 26, and 28 are typically rod-shaped bars having a shape similar to that of pencils, knitting needles, or wooden dowels. The engaging and disengaging means 20, 22, 26, and 28 are sufficient to support the weight distribution on the sheet 12 when a user sits on the seat 10. The engaging and disengaging means 20 and 26 comprise a pair of first or outer bars and the engaging and disengaging means 22 and 28 comprise a pair of second or inner bars, all being permanently attached to the sheet 12. Each narrow end 24 and 30 of the sheet 12 is engaged and disengaged by one of the pair of first bars 20 or 26 and one of the pair of second bars 22 or 28.

The engaging and disengaging means 20, 22, 26, and 28 have permanently attached end retention means 32 which protrude radially outward to prevent the engaging and disengaging means 20, 22, 26, and 28 from being separated from the sheet 12, either when the user is sitting on the seat 10, or when the seat 10 is being transported. This provides the dual advantage of operating as a safety feature, preventing the sheet 12 from falling when a user is sitting on the seat 10, and eliminating extra pieces which may be lost or too difficult to use by persons of limited dexterity. Obviously, any or all of the engaging and disengaging means 20, 22, 26, and 28, permanently affixed to the sheet 12, may be made shorter in length, or may include additional end retention means 32 to prevent any side-to-side movement of the means.

Continuing with FIG. 1, the sheet 12 has a top side 34 and a bottom side, including a middle section 36, and further has first and second wide edges 38 and 40 and first and second narrow ends 24 and 30 at first and second narrow edges 42 and 44. The first and second narrow ends 24 and 30 each have a pair of spaced slit cuts 46 extending toward the middle section 36 of the sheet 12. The slits 46 are substantially parallel to the wide edges 38 and 40 of the sheet 12 and substantially perpendicular to the narrow edges 42 and 44 of the sheet 12, defining a slit section at both the first and second narrow ends 24 and 30. The slit section defines a middle portion 48 and first and second side portions 50 and 52, respectively. The side portions 50 and 52 are folded over a first distance and sewn or otherwise permanently attached to a remaining section of the side portions 50 and 52, as illustrated in FIG. 1, to define a first pair of apertures at the first and second narrow ends 24 and 30 for receiving and securely holding both ends of the outer pair of engaging and disengaging means 20 and 26. The end retention means 32 prevent the engaging and disengaging means 20 and 26 from slipping out of the apertures created by the folded side portions 50 and 52.

The middle portion 48 of the slit section can be folded over a second distance and sewn or otherwise permanently attached to a remaining section of the middle portion 48, as illustrated in FIG. 1, to define a second aperture at the first and second narrow ends 24 and 30 for covering and securely holding a middle section of the inner pair of engaging and disengaging means 22 and 28. Although the inner pair of engaging and disengaging means 22 and 28 slide freely within the second aperture created by the folded over middle portion 48 and end sections 54 and 56 of the inner pair of engaging and disengaging means 22 and 28 extend outward from the covered middle section, the end retention means 32 prevent the engaging and disengaging means 22 and 28 from slipping out of the second aperture.

Figure 3:
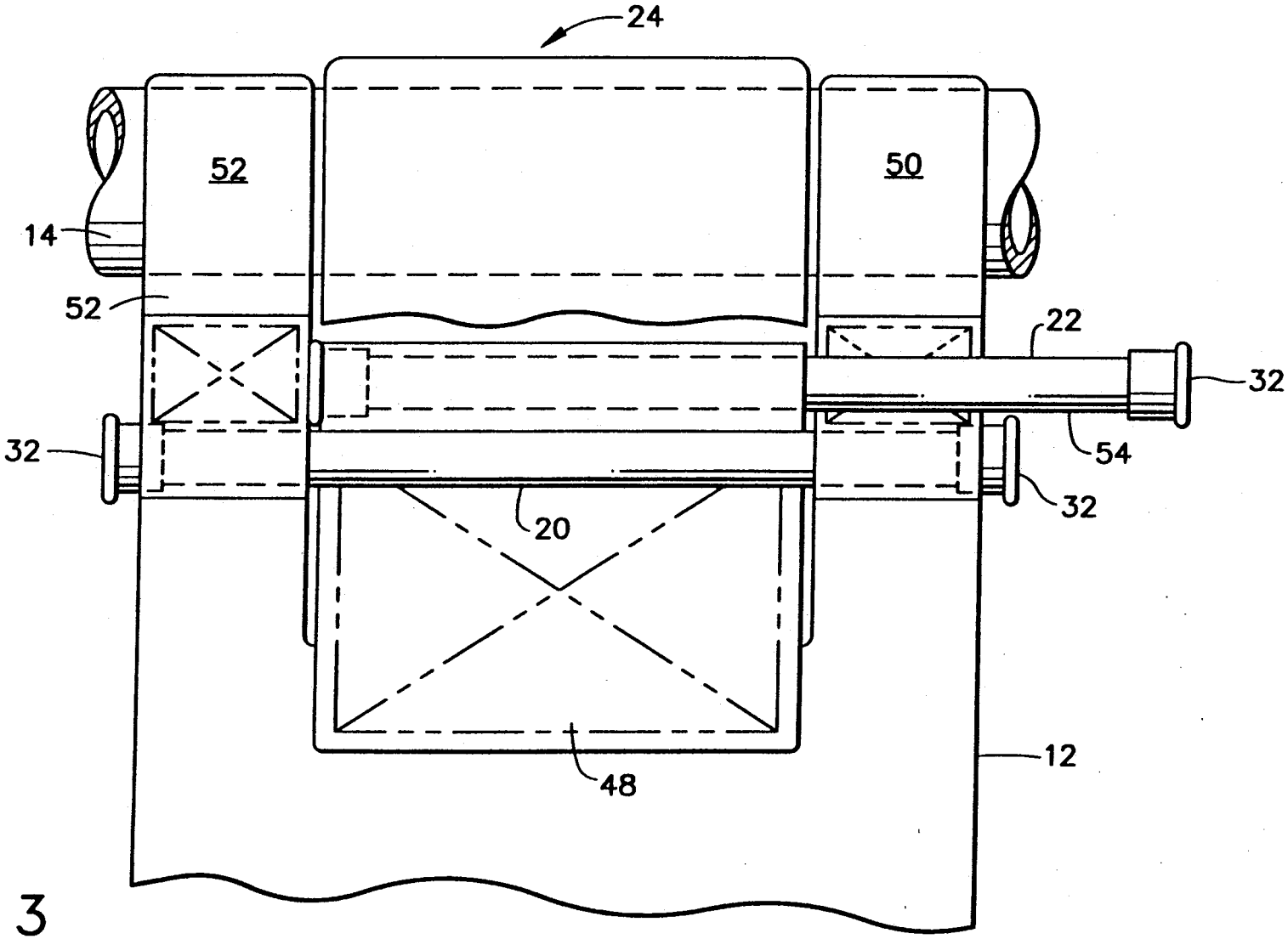
FIG. 3 is a partial view of the seat of FIG. 1 partially secured to the walker.
Figure 4:
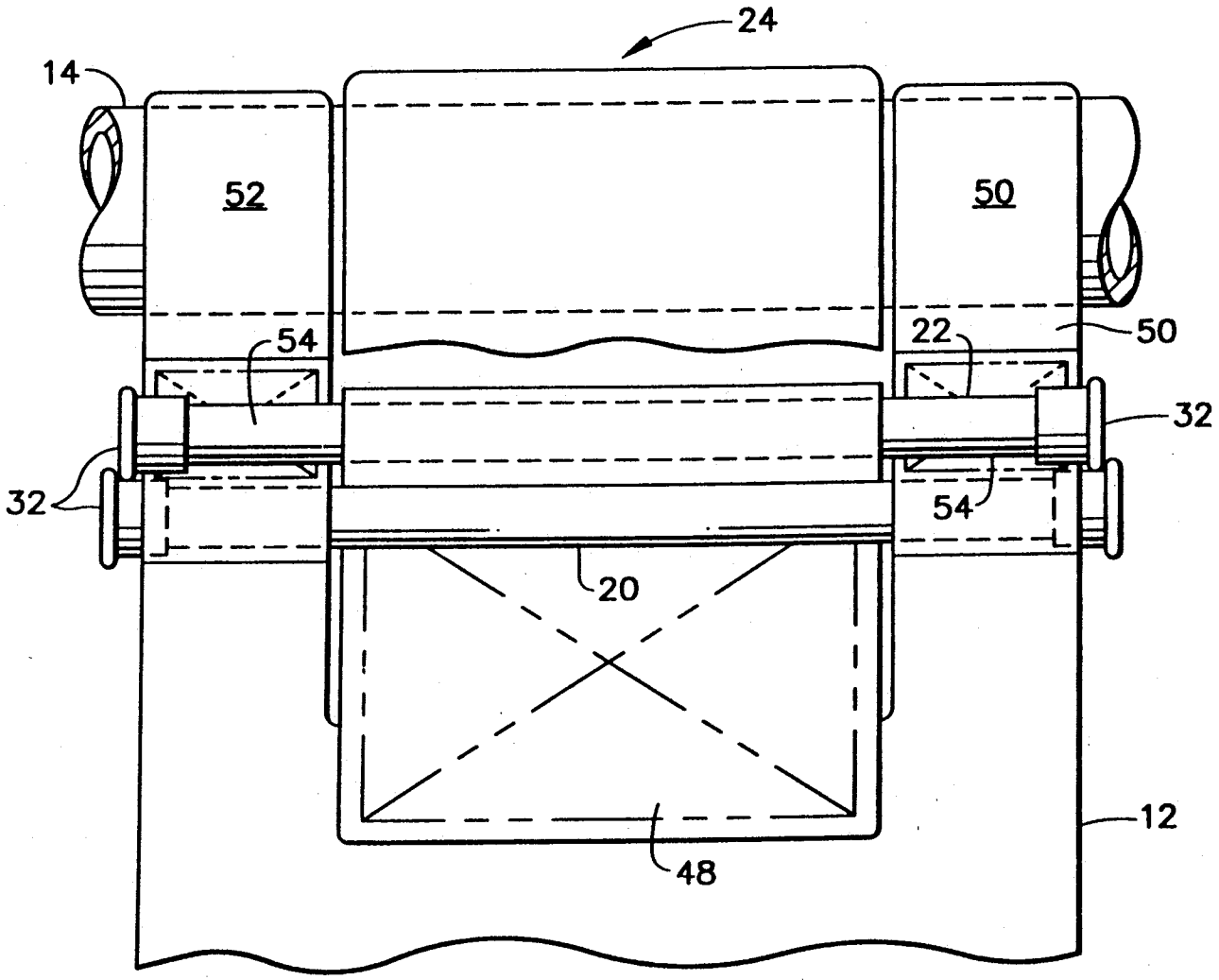
FIG. 4 is a partial view as shown in FIG. 3, with the seat of FIG. 1 completely secured to the walker.

Referring now to FIGS. 3 and 4, the seat 10 is shown partially and completely secured, respectively, to the frame member 14 of the walker 18. The engaging and disengaging means 20 may be folded over or under the frame member 14 of the walker 18, such that the engaging and disengaging means 20, 22, 26, and 28 are either inside or outside of the frame members 14 and 16. In FIGS. 3 and 4, the engaging and disengaging means 20 is folded over the frame member 14 for purposes of description only, and is not to be considered as limiting the invention. This causes the first and second end sections 54 and 56, respectively, of the inner engaging and disengaging means 22 and 28 to be covered by the folded side portions 50 and 52, defining a third aperture. The first and second end sections 54 and 56 can slide freely back and forth within the second aperture defined by the folded over middle portion 48 and the third aperture defined by the second fold of the folded side portions 50 and 53, until the first and second end sections 54 and 56 are pushed to an opposing side of the folded side portions 50 and 52. This secures the sheet 12 to the frame members 14 and 16 of the walker 18.

FIG. 3 illustrates how the engaging and disengaging means 22 can slide freely within the second and third apertures, limited only by the end retention means 32. The engaging and disengaging means 22 is maneuvered so that the end sections 54 and 56 are pulled out of the third aperture and pushed onto the top of the folded side portions 50 and 52, as illustrated in FIG. 4. The engaging and disengaging means 22 thereby locks the engaging and disengaging means 20 in place, so that the seat 10 cannot be removed from the walker 18 without maneuvering the engaging and disengaging means 20 and 22 out of the locking position shown in FIG. 4. The weight of the user on the sheet 12 actually pulls the engaging and disengaging means 20 and 22 closer together, in a more tightly locked position to prevent the sheet 12 from slipping out of place. Once weight is removed from the seat 10, the engaging and disengaging means 20 and 22, as well as 26 and 28, not shown in FIGS. 3 and 4, can be easily manipulated out of the locking position.

The present invention provides for a removable, one-piece walker seat capable of being secured to opposite horizontal frame members of virtually any existing walker, without modification of the walker. Two bars are sewn into each end of the seat to interact and secure the sheet in place on the walker, providing a person with a temporary walker seat. Obviously, the engaging and disengaging means may be varying lengths. Additionally, the end retention means may be any suitable shape to prevent the engaging and disengaging means from slipping out of the sheet 12, including a round knob or bead shape.

Having described the invention in detail and by reference to the preferred embodiment thereof, it will be apparent that other modifications and variations are possible without departing from the scope of the invention defined in the appended claims.

What is claimed is:

1. A seat for a walker comprising:

a substantially rectangular sheet of flexible material, the sheet having a middle section and a top side and a bottom side, and further having first and second wide edges, and first and second narrow ends at first and second narrow edges;

a pair of spaced slits at the first and second narrow ends, the pair of spaced slits extending toward the middle section of the sheet and being substantially parallel to the wide edges of the sheet and substantially perpendicular to the narrow edges of the sheet, forming a slit section at both the first and second narrow ends;

a pair of first bars and a pair of second bars permanently affixed to the first and second narrow ends of the sheet for engaging and disengaging the sheet to and from opposite horizontal frame members of the walker, and for suspending the sheet in a slack manner, the sheet and the cooperating to form the seat when the sheet is suspended across and engaged to the opposite horizontal frame members of the walker.

2. A seat for a walker as claimed in claim 1 wherein the slit second includes a middle portion bounded by first and second side portions.

3. A seat for a walker as claimed in claim 2 wherein the side portions are folded over a first distance and sewn to a remaining section of the side portions, to define a first pair of apertures at the first and second narrow ends for securely holding one of the first pair of bars at each of the first and second narrow ends.

4. A seat for a walker as claimed in claim 3 wherein the first pair of bars protrude radially outward at a first end and a second end to define end retention means for preventing the first and second ends from sliding through the first pair of apertures.

5. A seat for a walker as claimed in claim 4 wherein the middle portion of the slit section is capable of being folded over a second distance and sewn to a remaining section of the middle portion, to define a second aperture at the first and second narrow ends for covering and securely holding a middle section of the one of the second pair of bars at each of the first and second narrow ends, and allowing a first end section and a second end section of each of the second pair of bars to extend outward from the covered middle section.

6. A seat for a walker as claimed in claim 5 wherein the second pair of bars protrude radially outward to allow the second bar to slide freely within the second aperture while preventing either end of the second bar from sliding through the second aperture.

* * * * *